US010727634B2

(12) United States Patent
Wu et al.

(10) Patent No.: US 10,727,634 B2
(45) Date of Patent: Jul. 28, 2020

(54) CABLE CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/222,602

(22) Filed: Dec. 17, 2018

(65) Prior Publication Data

US 2019/0190216 A1 Jun. 20, 2019

(30) Foreign Application Priority Data

Dec. 15, 2017 (CN) ..... 2017 1 1343440

(51) Int. Cl.

| | |
|---|---|
| ***H01R 24/60*** | (2011.01) |
| ***H01R 13/6592*** | (2011.01) |
| ***H01R 13/6593*** | (2011.01) |
| *H01R 107/00* | (2006.01) |
| *H01R 12/53* | (2011.01) |

(52) U.S. Cl.

CPC ..... *H01R 24/60* (2013.01); *H01R 13/6592* (2013.01); *H01R 13/6593* (2013.01); *H01R 12/53* (2013.01); *H01R 2107/00* (2013.01)

(58) Field of Classification Search

CPC .. H01R 13/6592; H01R 9/034; H01R 9/2483; H01R 9/2691; H01R 12/2691; H01R 12/596; H01R 12/775

USPC ..... 439/676

See application file for complete search history.

(56) References Cited

U.S. PATENT DOCUMENTS 7,845,983 B2 * 12/2010 Kawada ..... H01Q 1/1271 439/607.46
7,997,909 B2 * 8/2011 Xu ..... H01R 13/6594 439/607.57
8,039,749 B2 * 10/2011 Okano ..... H01B 11/1008 174/113 R (Continued)

FOREIGN PATENT DOCUMENTS

CN 202422804 9/2012
CN 203013336 6/2013

(Continued)

*Primary Examiner* — Peter G Leigh

(74) *Attorney, Agent, or Firm* — Wei Te Chung; Ming Chieh Chang

(57) ABSTRACT

A cable connector assembly includes an electrical connector and a cable, the electrical connector comprising a plug mated with a mating connector, a circuit board connected between the plug and the cable, and a housing disposed outside the circuit board, the cable comprising a number of core wires and a shielding layer covering the core wires, the housing electrically connected to the shielding layer, wherein the housing is grounded to the circuit board.

16 Claims, 10 Drawing Sheets

(56) References Cited

U.S. PATENT DOCUMENTS 8,439,706 B2 * 5/2013 Sytsma ..... H01R 13/65802 439/607.19
8,911,262 B1 * 12/2014 Leiba ..... H01R 24/60 439/660
9,244,240 B2 1/2016 Hayashishita
9,490,581 B2 * 11/2016 Ng ..... H01R 13/646
9,508,467 B2 * 11/2016 Pon ..... H01B 9/003
9,553,409 B2 * 1/2017 Deng ..... H01R 13/6581
2010/0084157 A1 * 4/2010 Wang ..... H01B 11/12 174/107
2010/0258333 A1 10/2010 Horan et al.
2011/0256756 A1 * 10/2011 Lu ..... H01B 7/0892 439/449
2011/0278043 A1 * 11/2011 Ueda ..... H01B 7/1895 174/115
2012/0103651 A1 5/2012 Kim
2012/0227996 A1 9/2012 Ardisana, II et al.
2013/0264091 A1 10/2013 Watanabe
2014/0305675 A1 10/2014 Liang et al.
2016/0020002 A1 * 1/2016 Feng ..... H01B 11/20 174/103
2016/0079689 A1 3/2016 Wu et al.
2016/0079714 A1 3/2016 Wu et al.
2016/0156136 A1 * 6/2016 Kao ..... H01R 13/6585 439/607.05
2016/0172804 A1 * 6/2016 Wu ..... H01R 24/60 439/676
2016/0211055 A1 * 7/2016 Glew ..... H01B 7/295
2016/0268744 A1 * 9/2016 Little ..... H01R 24/60
2017/0025203 A1 * 1/2017 Chen ..... H01B 11/20
2017/0149153 A1 * 5/2017 Gou ..... H01R 12/53
2017/0207589 A1 * 7/2017 Wu ..... H01R 24/60
2018/0303013 A1 * 10/2018 Li ..... H05K 9/0088

FOREIGN PATENT DOCUMENTS

CN 204884664 * 12/2015
CN 106936031 4/2017
CN 206558836 U * 10/2017

* cited by examiner

CABLE CONNECTOR ASSEMBLY

BACKGROUND OF THE INVENTION

1. Field of the Invention

The present invention relates to a cable connector assembly for transmitting a high current.

2. Description of Related Arts

With wide application of USB (Universal Serial Bus) Type C interface, the DisplayPort alternate mode USB C, and the HDMI (High-Definition Multimedia Interface) alternate mode USB C have gradually matured and developed, and the length of AV cable assembly is mostly in 1.8 in or 2.0 in. In addition to the advantages of the USB C in providing high-quality, high-frequency data transmission, the large current 3 A and even 5 A specified in the USB PD (Power Delivery) protocol have been highly sought after by various system manufacturers. The transmission of high current means more power loss of cables, which is usually overcome by increasing diameter of cable wire conductor. However, it is preferred to have thin and flexible cables.

China Patent Application No. 106936031, issued on Jul. 7, 2017, discloses a cable including an outer covering, an inner covering, an outer shielding layer disposed between the outer covering and the inner covering, a differential signal core wire, a power core wire, and a control signal core wire. Each of the differential signal core wire, the power core wire, and the control signal core wire includes a conductor and an insulative layer covering the conductor. The differential signal core wire further includes an inner shielding layer covering the insulative layer. However, when transmitting a high current, with temperature rise, the cable may have a high power loss.

Therefore, there is a need to provide an improved cable connector assembly.

SUMMARY OF THE INVENTION

An object of the present invention is to provide a cable connector assembly that transmits large current.

To achieve the above-mentioned object, a cable connector assembly comprises: an electrical connector and a cable, the electrical connector comprising a plug mated with a mating connector, a circuit board connected between the plug and the cable, and a housing disposed outside the circuit board, the cable comprising a number of core wires and a shielding layer covering the core wires, the housing electrically connected to the shielding layer, wherein the housing is grounded to the circuit board.

According to the present invention, the cable connector assembly connects between the shielding layer and the housing through the circuit board, which reduces resistance to current flow, thereby reducing heat and permitting transmission of higher current.

DETAILED DESCRIPTION OF THE PREFERRED EMBODIMENT

Figure 1:
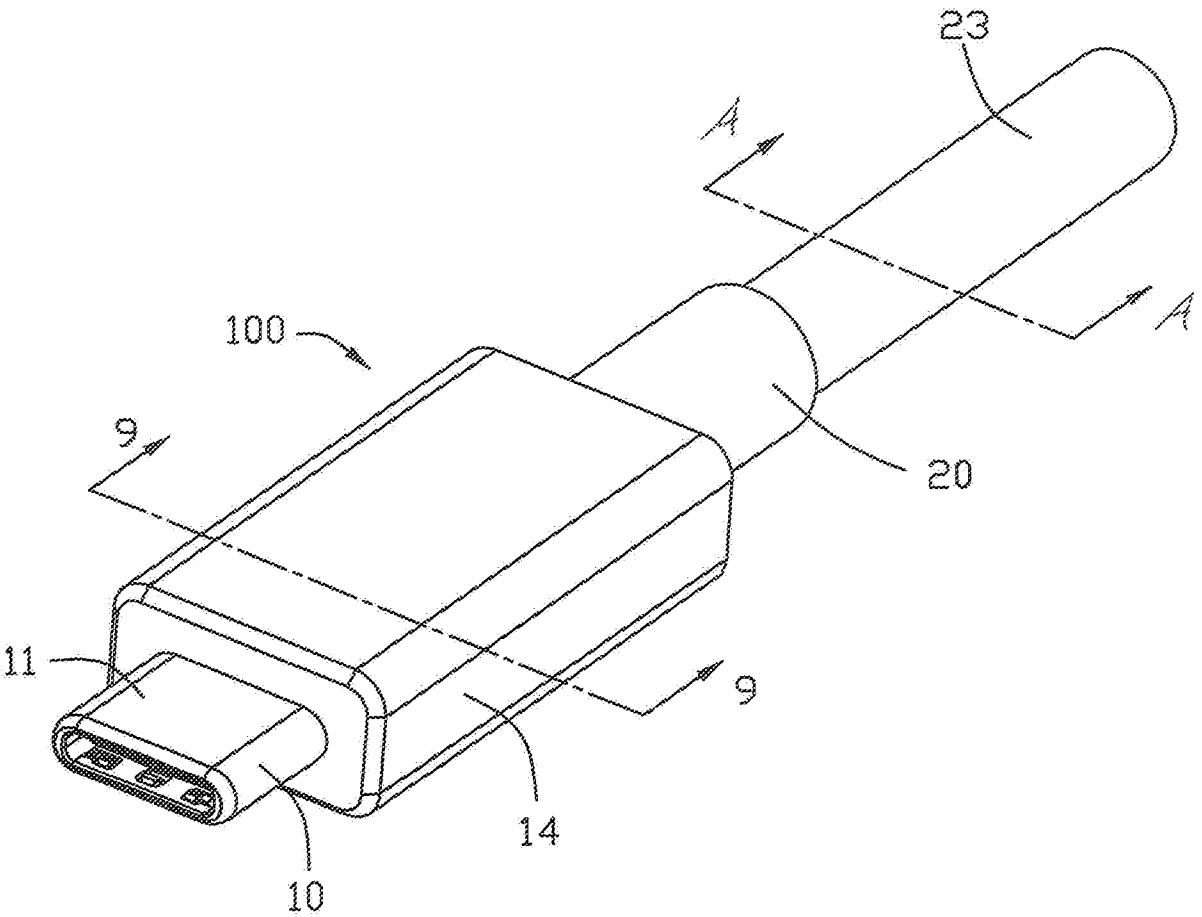
FIG. 1 is a perspective view of a first embodiment of a cable connector assembly in accordance with present invention.
Figure 2:
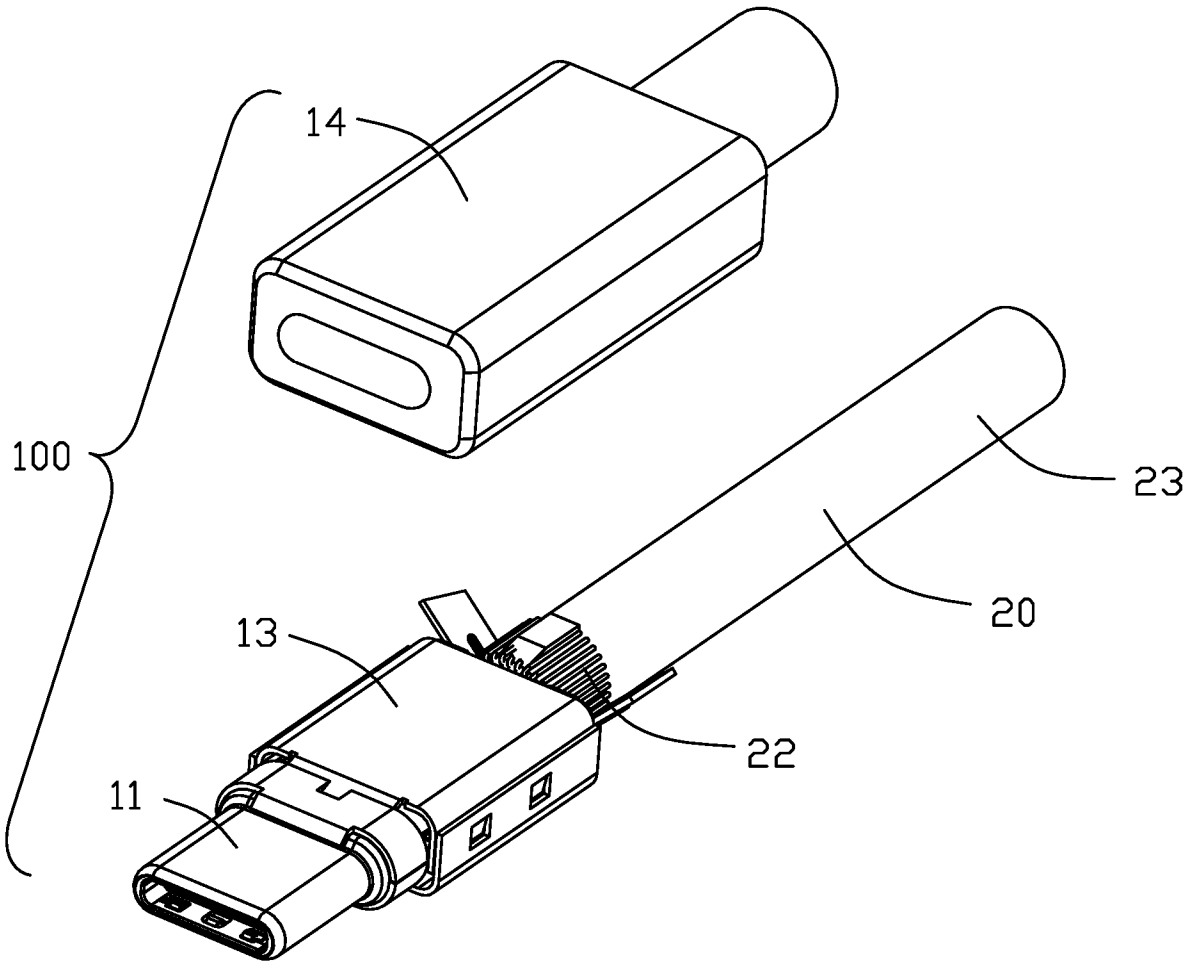
FIG. 2 is a partly exploded view of the cable connector assembly as shown in FIG. 1.
Figure 3:
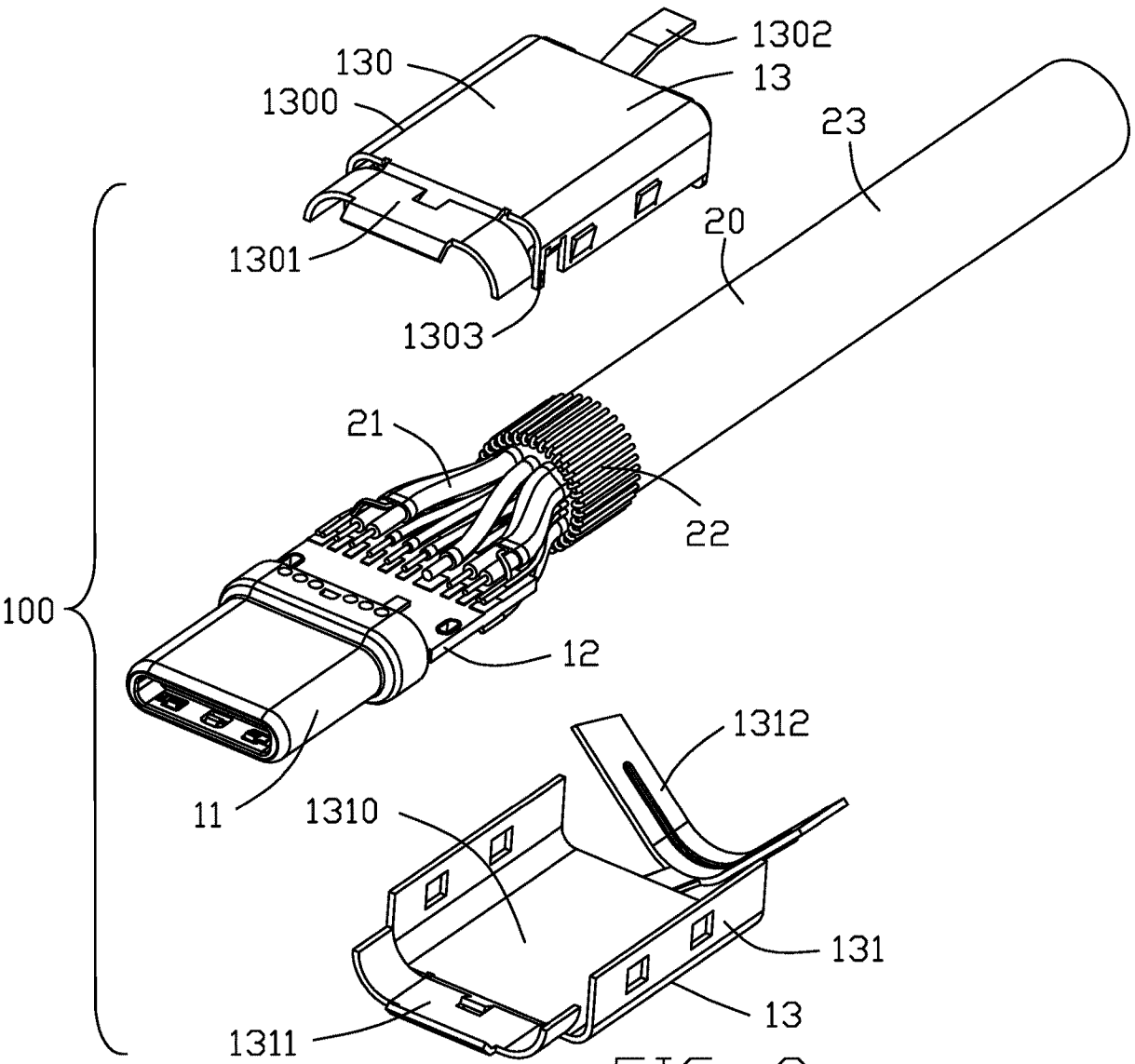
FIG. 3 is a partly further exploded view of the cable connector assembly as shown in FIG. 2.
Figure 4:
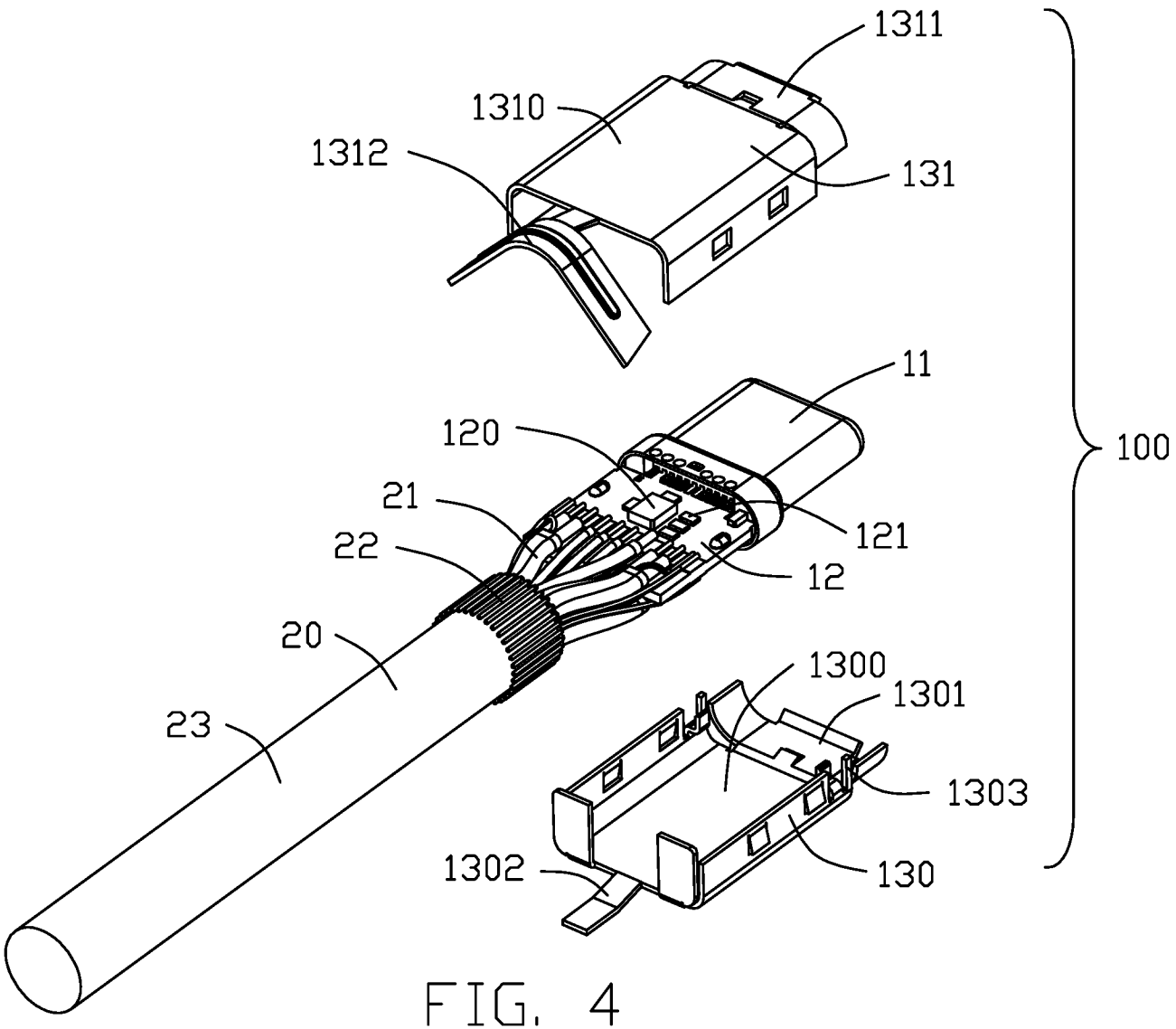
FIG. 4 is a partly further exploded view of the cable connector assembly as shown in FIG. 3, but from a different perspective.
Figure 5:
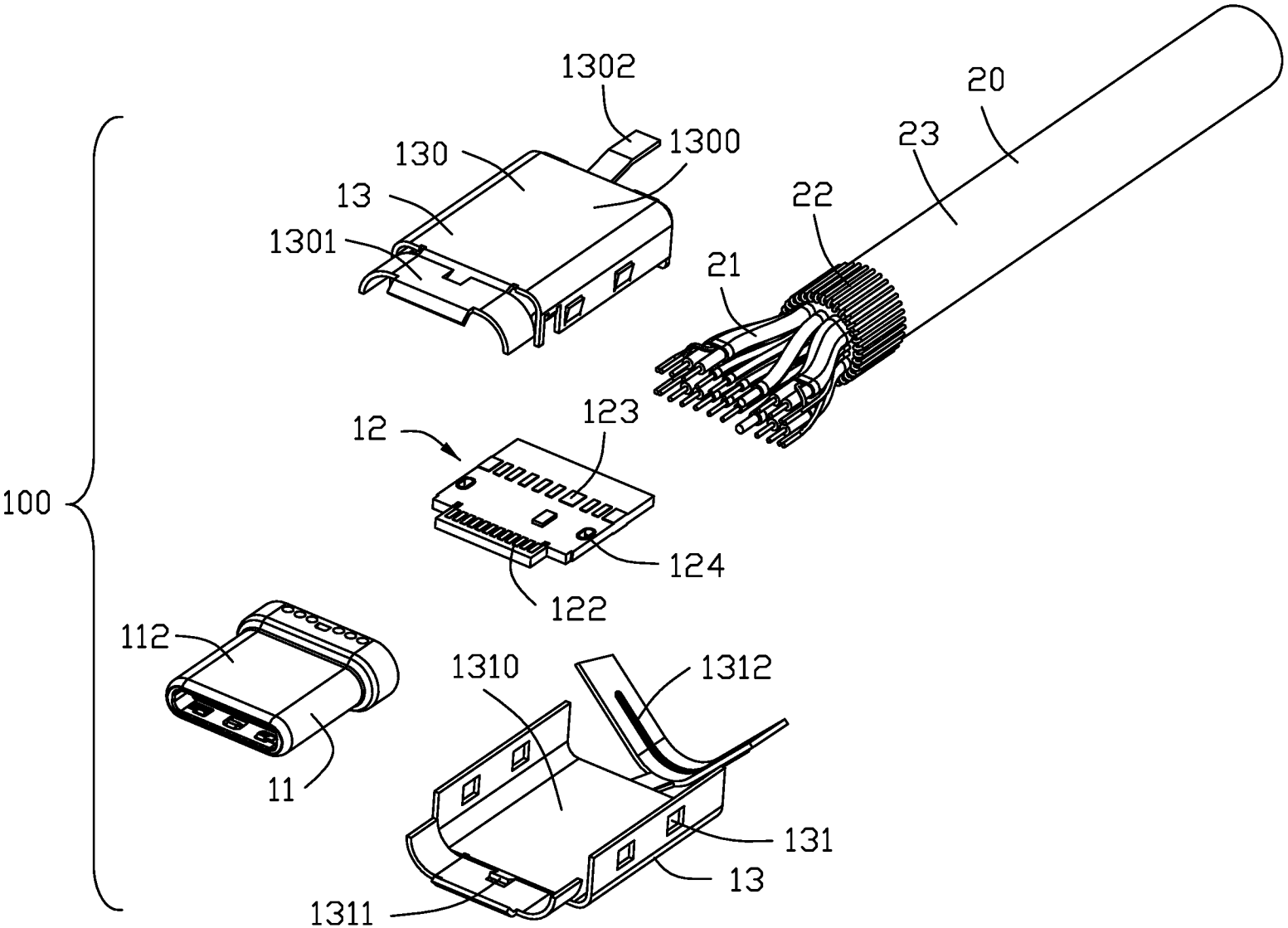
FIG. 5 is an exploded view of the cable connector assembly as shown in FIG. 1.
Figure 6:
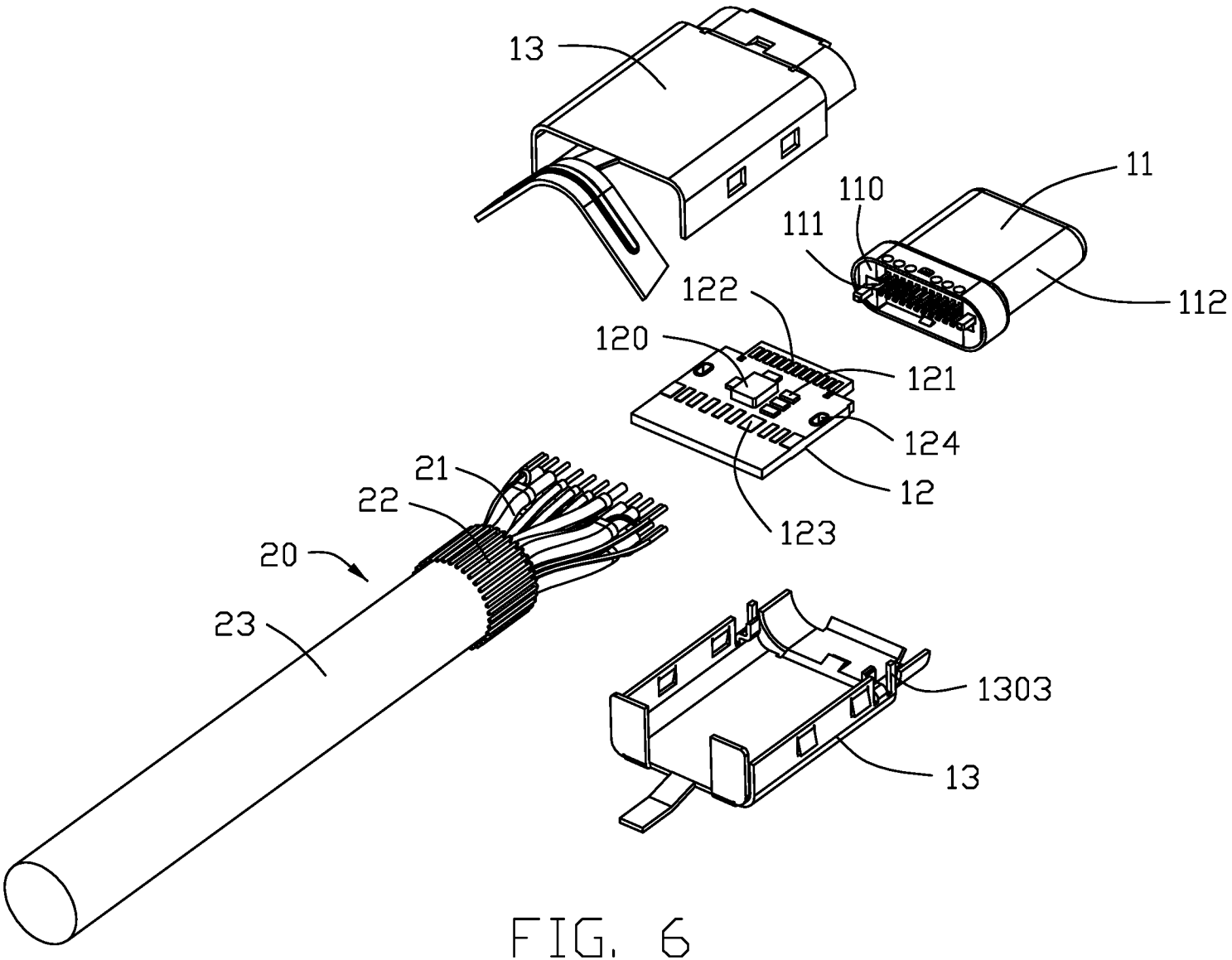
FIG. 6 is an exploded view of the cable connector assembly as shown in FIG. 5, but from a different perspective.
Figure 7:
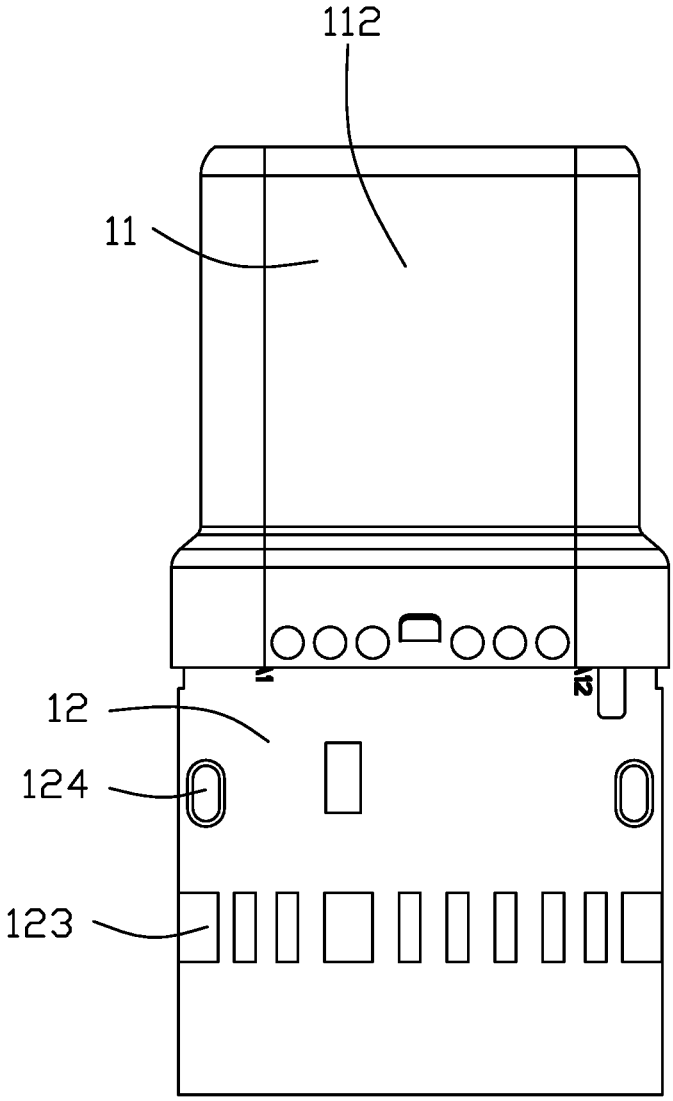
FIG. 7 is a top view of the plug and the circuit board of the cable connector assembly as shown in FIG. 1.
Figure 8:
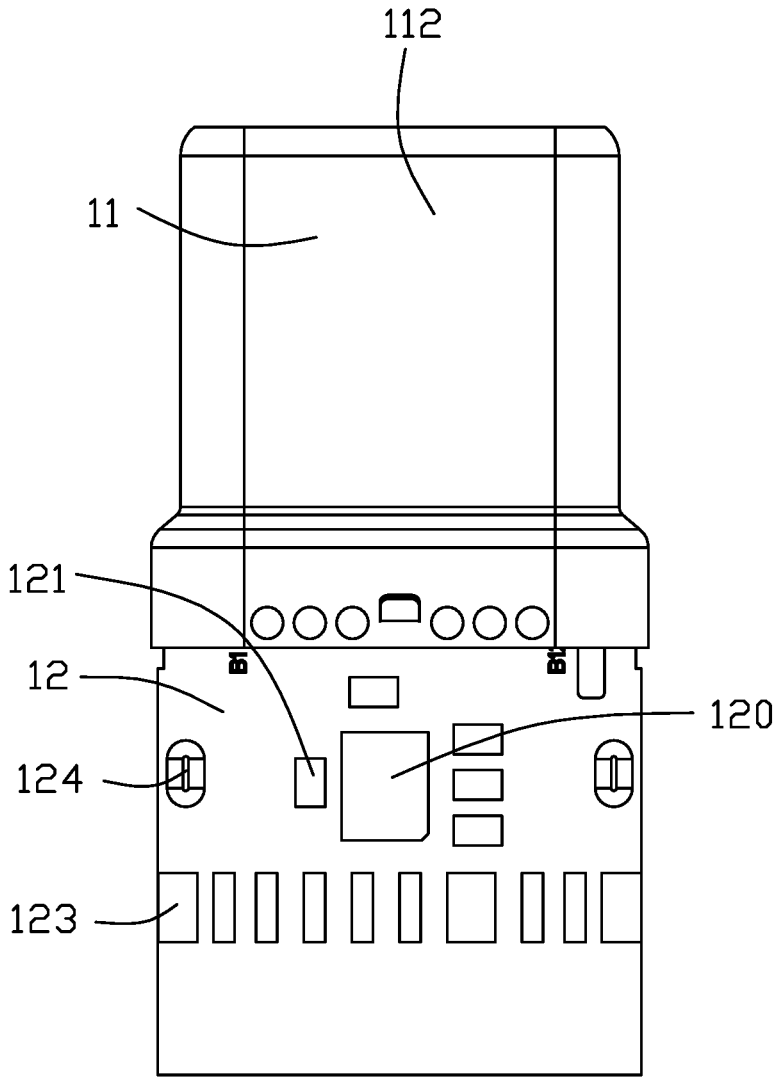
FIG. 8 is a bottom view of the plug and the circuit board as shown in FIG. 7.
Figure 9:
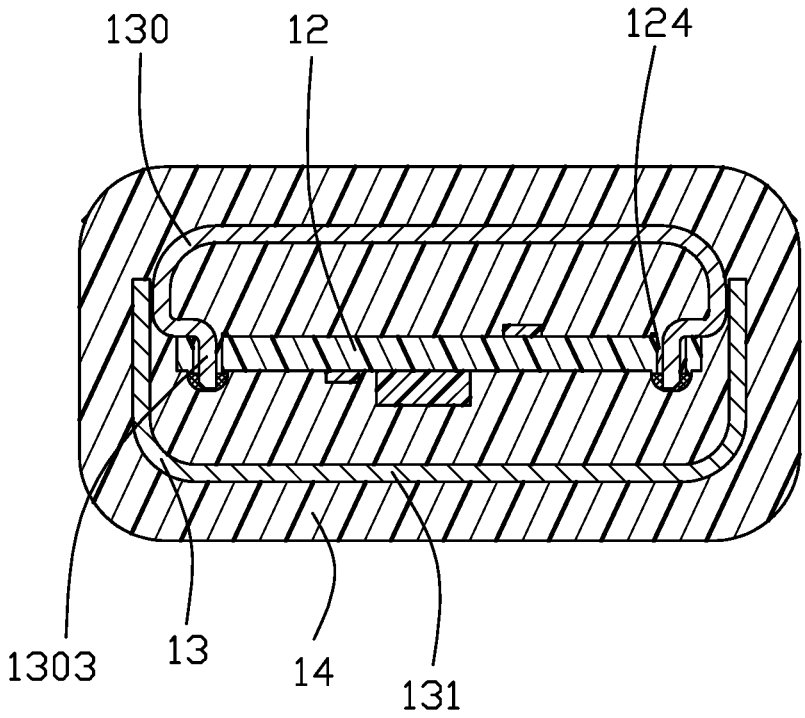
FIG. 9 is a cross-sectional view taken along line 9-9 in FIG. 1.
Figure 10:
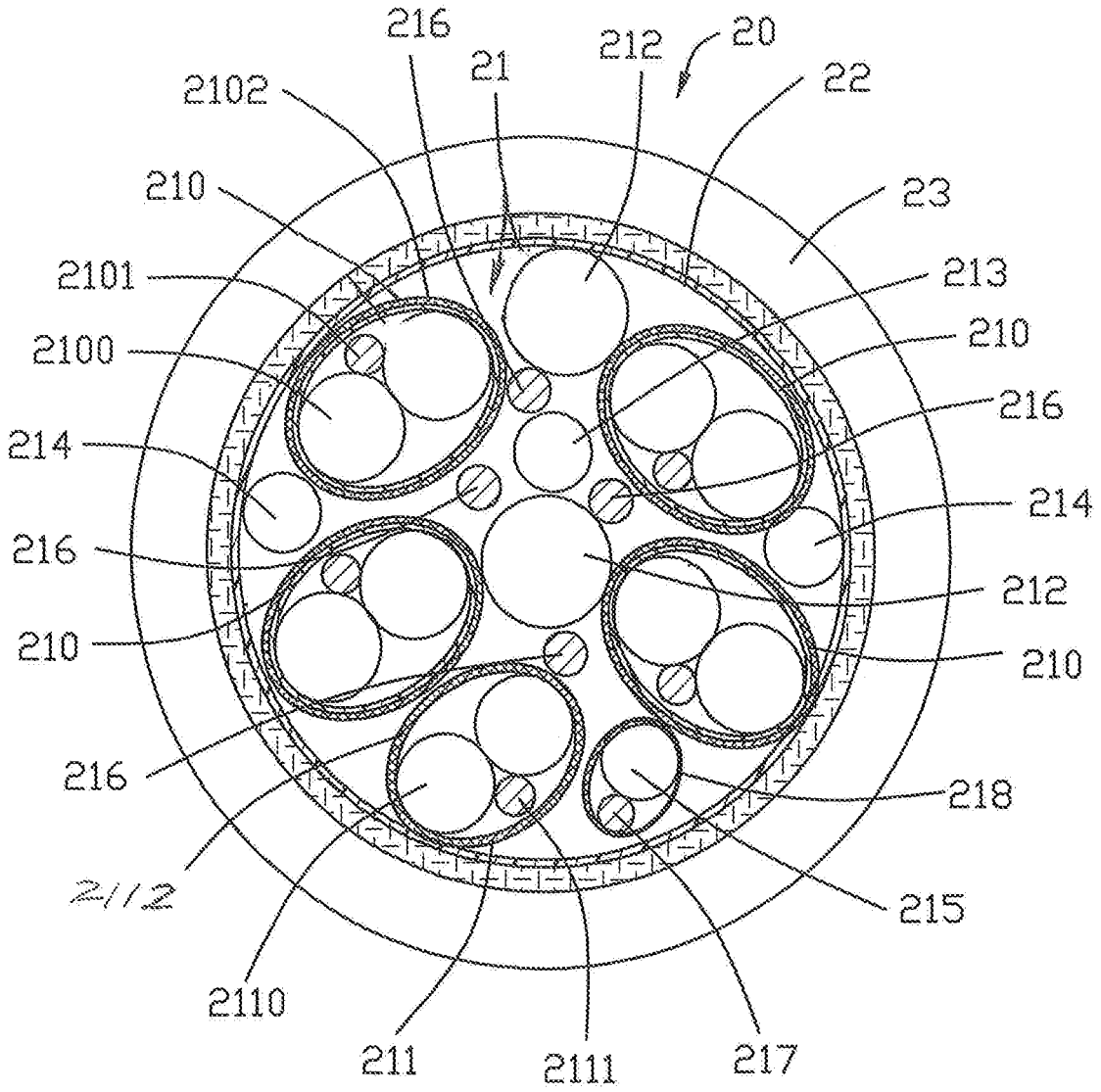
FIG. 10 is a cross-sectional view taken along line A-A in FIG. 1.

Reference will now be made in detail to a preferred embodiment of the present invention. Referring to FIGS. 1 to 10, the cable connector assembly 100 includes an electrical connector 10 and a cable 20 connected to electrically connector 10. The electrical connector 10 includes a plug 11 mated with a mating connector, a circuit board 12 connected between the plug 11 and the cable 20, a metallic housing 13 disposed outside the circuit board 20, and a cage 14 disposed outside the housing 13. In the present embodiment, the electrical connector 10 conforms to the USB C specification, which can be mated with the mating connector in two opposite directions.

The plug 11 includes an insulative body 110, a plurality of terminals 111 which are received in the insulative body 110 and spaced in two rows in up and down directions, and a metal shell 112 disposed outside the insulative body 110. One end of the terminals 111 is received in the insulative body 110 for being mechanically and electrically connected with the mating connector, and the other end of the terminals 111 extends beyond the insulative body 110 and is mechanically and electrically connected with one end of the circuit board 12.

A chip 120 and other elements 121 are mounted on the circuit board 12. Both sides of the front end of the circuit board 12 define a plurality of front end pads 122, and both sides of the rear end of the circuit board 12 define a plurality of rear end pads 123, and the side edge of the circuit defines a through hole 124 through the circuit board 12. The number of the through hole 124 is at least one. In the present embodiment, the number of the through holes 124 is two, and the two through holes 124 are disposed at the opposite two sides of the circuit board 12.

The housing 13 includes a first housing 130 and a second housing 131 mated with the first housing 130. The first housing 130 includes a first body portion 1300, a first mating portion 1301 extending forward from the first body portion 1300, and a first connection portion 1302 extending rearward from the first body portion 1300. The second housing 131 includes a second body portion 1310, a second mating portion 1311 extending forward from the second body portion 1310, and a second connection portion 1312 extending rearward from the second body portion 1310. The first mating portion 1301 and the second mating portion 1311 are mounted outside the rear end of the metal shell 112 of the plug 11, so that the housing 13 is mechanically and electrically connected with the metal shell 112 of the plug 11. The first housing 130 clipped on the second housing 131. The first housing 130 defines a mounting portion 1303 mating with a pair of the through holes 124 of the circuit board 12. The mounting portion 1303 is inserted into the corresponding through hole 124, and further soldered with the through hole 124, so that the mounting portion 1303 can be stably grounded to a grounding layer of the circuit board 12. The ground connection between the housing 13 and the circuit board can also be achieved by spring fit, clip, or the like.

The cable 20 includes a plurality of core wires 21, a shielding/braiding layer 22 covering the core wires 21, and an insulative layer 23 covering the shielding layer 22. The material of the shielding layer 22 is typically metal woven material, or further added with a metal foil. The core wire 21 is soldered with the opposite rear end pad 123 of the circuit board 12. The first connection portion 1302 is electrically connected with the shielding layer 22, and the second connection portion 1312 is riveted to the shielding layer 22 and then is further riveted to the first connection portion 1302, so that the housing 13 can be electrically connected with the shielding layer 22 of the cable. The core wire 21 includes a plurality of differential signal core wire group 210 that transmit a high-speed differential signal, a low-speed signal core wire group 211 that transmits a low-speed signal, a pair of large power core wires 212 that transmit a high current, a small power core wire 213 that transmits a low current, a pair of spare core wires 214, and a control signal core wire 215 that transmits a control signal. The differential signal core wire group 210 includes a pair of coaxial wires 2100, a bare/drain wire 2101 disposed outside the coaxial wires 2100, and a shielding layer 2102 covering the bare wire 2101 and the coaxial wires 2100. The low-speed signal core wire group 211 includes a pair of twisted wires 2110, a bare/drain wire 2111 disposed outside the twisted wires 2110, and a shielding layer 2112 covering the bare wire 2111 and the twisted wires 2110, thereby effectively reducing the external radiation and enhance its anti-interference ability. A pair of large power core wires 212 is connected with the circuit board 12, so that can achieve the total 5 A high current, low power loss, low temperature rise, voltage drop of 500 mV, and the temperature rise would not more than 25° C. during use. The differential signal core wire group 210 is disposed outside thereof, at least the low-speed signal core wire group 211, one of the large power core wire 212, a pair of spare wires 214, and the control signal core wire 215 is disposed between each of the adjacent differential signal core wire group 210. Specifically, in the present embodiment, the number of the differential signal core wire group 210 is four, and the number of the differential signal core wire group 210 can be increased or decreased according to specific requirements, and at least two differential signal core wire groups 210 are spaced between the pair of spare wires 214. A pair of the adjacent differential signal core wire groups 210 which has the low-speed core wire group 211 disposed therein have the control signal core wire 215 disposed therein, so that it can reduce the low frequency of the low-speed signal core wire group 211. This setting can increase the distance between the pair of spare core wires and the control signal core wire 215 to prevent mutual coupling and crosstalk of low-speed signal core wire group 211. The other large power core wire 212 is disposed at an inner layer of the cable 20, and the small power core wire 213 is disposed between the pair of the large power core wires 212. The cable 20 further includes a plurality of bare/drain wires 216 disposed at the inner layer, and the plurality of bare wires 216 are used as grounding. The cable 20 further includes a bare/drain wire 217 disposed adjacent the control signal core wire 215, and a shielding layer 218 covering the bare wire 217 and the control signal core wire 215, the bare wire 217 being used as grounding to effectively prevent noise crosstalk. The small power core wire 213 is used to supply power to the chip 120 on the circuit board 12.

All of the bare/drain wires 2101, 2111, 216, 217 are electrically connected with the grounding layer of the circuit board 12, and further connected in series with the housing 13 and the shielding layer 22 of the cable as a power circuit for a large current. Thereby, the resistance of the power circuit of a large current can be significantly reduced and the voltage is lowered by 500 mV.

The cable connector assembly 100 connects the shielding layer 22 of the cable 20 and the housing 13 through the circuit board 12, thereby reducing the resistance of the power circuit, thereby reducing heat generation and transmitting a higher current.

Notably, there are twenty-two terminals 111 in the connector 10 wherein twelve terminals are arranged in one row, which are identified as a ground, a high speed differential pair, a power, a CC, a lower speed differential pair, a SBU1, a power, a high speed differential pair and a ground, and the remaining ten terminals area arranged in another row, which are identified as a ground, a high speed differential pair, a power, a VCC, a SBU2, a ground, a high speed differential pair and a ground. Differently, there are ten rear conductive pads 123 on each surface of the printed circuit board 12 wherein those on one surface are identified as a ground, a high speed differentia pair, a power, a low differential pair, a SBU1, a high speed differential pair and a ground and those on the other surface are identified as a ground, a high speed differential pair, a CC, a VCC, a SBU2, a power, a high differential pair and a ground. Understandably, the twenty rear conductive pads 123 correspond, in number, to the twenty-two terminals 111, respectively, except that the power pad and the power terminals. Each ground pad 123 is electrically connected to the four ground terminals 111, and each power pad 123 is electrically connected to the four power terminals 111. Correspondingly, the four high speed differential pairs 210 are respectively soldered upon the corresponding four high speed differential pair pads 123, each ground pad 123 corresponds to a bare/drain wire 2101 of the neighboring high speed differentia pair wires 210, and one bare/drain 216/217/2111. In this embodiment, the high speed differential pair of the core wires, i.e., the signal core wire group 210, has two outer layers including the shielding layer 2102, successively enclosing both the coaxial wires 2100 and the bare wire 2101 while the low speed differential pair of the core wires, i.e., the signal core wire group 211, only has one layer enclosing the twisted wires 2110 and the corresponding bare wire 2111.

What is claimed is:

1. A cable connector assembly comprising:

an electrical connector comprising a plug for mating with a mating connector, a circuit board connected to the plug, and a metallic housing disposed outside the circuit board; and a cable connected to the circuit board, the cable comprising a number of core wires and a shielding layer covering the core wires, the housing electrically connected to the shielding layer; wherein the housing is grounded to the circuit board;

the circuit board comprises a pair of holes spaced apart from each other, the housing comprises a pair of mounting portions inserted into the pair of holes for grounding connection of the housing and the circuit board;

the core wires comprise plural pairs of differential signal core wire groups transmitting high speed differential signal, a low speed signal core wire group transmitting low speed signal, a pair of large power core wires transmitting a high current, a small power core wire transmitting a low current, a pair of spare core wires, and a control signal core wire transmitting control signal; and the differential signal core wire groups are disposed in an outer layer, and the low speed signal core wire group, one of the large power core wires, the pair of spare core wire, and the control signal core wire are disposed between adjacent differential signal core wire groups.

2. The cable connector assembly of claim 1, wherein the other large power core wire is disposed in an inner layer, and the small power core wire is disposed between the pair of large power core wires.

3. The cable connector assembly of claim 1, wherein the low speed signal core wire group and the control signal core wire are disposed between one pair of differential signal core wire group.

4. The cable connector assembly of claim 3, wherein the cable further comprises a bare wire disposed adjacent the control signal core wire, and a shielding layer covering the bare wire and the control signal core wire, the bare wire serving as a grounding and a power circuit of high current.

5. The cable connector assembly of claim 4, wherein the cable further comprises a number of bare wires disposed in an inner layer, the number of bare wires serving as a grounding and a power circuit of high current.

6. The cable connector assembly of claim 1, wherein the low speed signal core wire group comprises a pair of twisted pairs, a bare wire disposed outside the twisted pairs, and a shielding layer covering the bare wire and the twisted pair.

7. A cable connector assembly comprising:

an electrical connector including a plug for mating with a receptacle connector, a printed circuit board located behind and connected to the plug;

two rows of terminals disposed in the plug wherein one row has ten terminals and the other has twelve terminals;

a cable connected to a rear portion of the printed circuit board and including a braiding layer enclosing a plurality of core wires;

a metallic housing grasping a rear portion of the plug, covering the printed circuit board and grasping the braiding layer; and said printed circuit board includes opposite surfaces on each of which there are ten rear conductive pads in one row, on which the core wires are respectively soldered, corresponding to the respective terminals in numbers except that there are only two power conductive pads of said conductive pads correspond to four power terminals of said terminals.

8. The cable connector assembly as claimed in claim 7, wherein the core wires include four high speed differential pairs and one low speed differential pair, and each of said high speed differential pairs and the low speed differential pair has one corresponding drain.

9. The cable connector assembly as claimed in claim 7, wherein there are two rear conductive ground pads on each surface of the printed circuit board and located at two opposite ends thereof, and each of said ground pads is electrically connected to all four ground terminals of said terminals.

10. The cable connector assembly as claimed in claim 9, wherein the core wires include four differential pairs each equipped with a bare wire soldered upon one corresponding ground pad.

11. The cable connector assembly as claimed in claim 10, wherein each of said ground pads is further equipped with a drain wire soldered thereon.

12. The cable connector assembly as claimed in claim 9, wherein there is only one conductive power pad on each surface of the printed circuit board electrically connected to all four power terminals of said terminals.

13. A cable connector assembly comprising:

an electrical connector including a plug for mating with a receptacle connector, a printed circuit board located behind and connected to the plug;

two rows of terminals disposed in the plug and mechanically and electrically connected to the printed circuit board;

a cable connected to a rear portion of the printed circuit board and including a braiding layer enclosing a plurality of core wires; and a metallic housing grasping a rear portion of the plug, covering the printed circuit board and grasping the braiding layer; wherein said metallic housing is mechanically and electrically connected to the printed circuit board; and the printed circuit board includes two opposite surfaces each forming one row of conductive pads thereon to be soldered with the corresponding core wires, and there are two conductive ground pads in each row on each of said two opposite surfaces, and each of said ground pads is equipped with two drain wires soldered thereon, and one of said two drain wires belongs to one corresponding high speed differential pair.

14. The cable connector assembly as claimed in claim 13, wherein said metallic housing is securely fixed to the printed circuit board.

15. The cable connector assembly as claimed in claim 13, wherein said core wires includes four high speed differential pairs and one low speed differential pair, and each of said high speed differential pairs has a pair of coaxial wires and a drain wire commonly enclosed within two layers including one shielding layer while the low speed differential pair has a pair of wires and a drain wire commonly within only one shielding layer.

16. The cable connector assembly as claimed in claim 13, wherein the terminals include ten terminals in one row and twelve terminals in another row, while the printed circuit board includes two opposite surfaces each forming one row of conductive pads thereon to be soldered with the corresponding core wires, wherein the conductive pads in each row has ten conductive pads corresponding to said terminals.

* * * * *